United States Patent [19]

Uedaira

[11] 4,101,389

[45] Jul. 18, 1978

[54] METHOD OF MANUFACTURING AMORPHOUS ALLOY

[75] Inventor: Satoru Uedaira, Yokohama, Japan

[73] Assignee: Sony Corporation, Tokyo, Japan

[21] Appl. No.: 797,241

[22] Filed: May 16, 1977

[30] Foreign Application Priority Data

May 20, 1976 [JP] Japan ..... 51-58305
Feb. 5, 1977 [JP] Japan ..... 52-11876

[51] Int. Cl.[2] ..... C25D 3/56
[52] U.S. Cl. ..... 204/44; 204/43 P; 204/123
[58] Field of Search ..... 204/43 P, 44, 123

[56] References Cited

U.S. PATENT DOCUMENTS 3,354,059 11/1967 Koretzky ..... 204/12

FOREIGN PATENT DOCUMENTS 325,276 2/1972 U.S.S.R. ..... 204/43 P
246,253 11/1969 U.S.S.R. ..... 204/43 P
264,098 6/1970 U.S.S.R. ..... 204/43 P
264,099 6/1970 U.S.S.R. ..... 204/43 P

OTHER PUBLICATIONS

IBM Tech. Disclosure Bulletin, vol. 16, No. 8, pp. 2583–2584, Jan. 1974.

*Primary Examiner*—G. L. Kaplan
*Attorney, Agent, or Firm*—Hill, Gross, Simpson, Van Santen, Steadman, Chiara & Simpson

[57] ABSTRACT

A method of manufacturing an amorphous alloy in which there is provided an acidic plating bath consisting predominantly of divalent iron ions and a source of hypophosphite ions, and electroplating from such a bath to produce a plated layer of an amorphous alloy consisting predominantly of iron and phosphorous.

13 Claims, 12 Drawing Figures

1.0
0.8
0.6
0.4
0.2
0
-0.2
-0.4
-0.47
-0.6
-0.8
Eh
(mV)
$Fe^{3+}$
$Fe(OH)_3$
$Fe^{2+}$
1mol/l
$Fe(OH)_2$
Fe
0
2
4
6
8
10
12
14
PH VALUE OF PLATING BATH

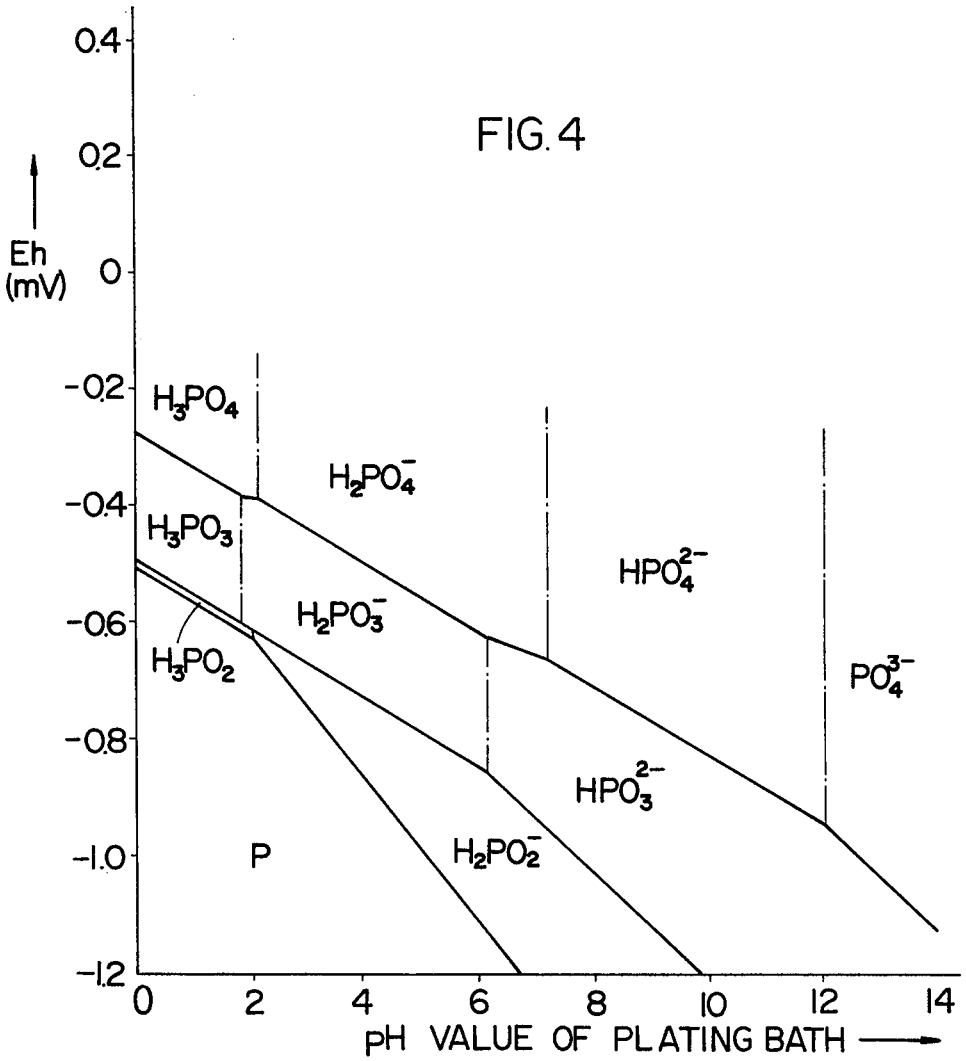
FIG. 5
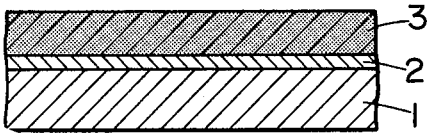

METHOD OF MANUFACTURING AMORPHOUS ALLOY

BACKGROUND OF THE INVENTION

1. Field of the Invention

This invention relates to the manufacture of amorphous alloys consisting predominantly of iron and phosphorous.

2. Description of the Prior Art

Recently, there has been developed an amorphous alloy of improved physical properties, particularly thermal, electrical and magnetic properties. The amorphous alloy has in general the following advantages:

(a) Its mechanical strength is greater than crystalline metal materials;

(b) Its modulus of rigidity is lower than that of crystalline metals by 20 to 40%;

(c) It does not exhibit work hardening;

(d) Its electrical resistance is generally high;

(e) Its corrosion resistance can be substantially improved by the addition of chromium and the like; and (f) It provides an alloy of high permeability.

The conventional method of manufacturing such an amorphous alloy is known as a spattering method, usually in the form of a quenching method. According to the quenching method, iron group metals and at least two elements which form amorphous alloys with iron such as phosphorous, carbon, boron and silicon are mixed and melted when the mixture is cooled before being crushed. The resulting crushed mixture is melted again and then quenched by spraying and the like to produce an amorphous alloy. An amorphous alloy film can be manufactured in this manner, but it is necessary to add at least two amorphous alloy forming elements to the alloy to provide a eutectic which has a melting temperature substantially lower than that of iron. Accordingly, in the conventional methods, an amorphous alloy consisting solely of iron and phosphorous, for example, cannot be manufactured. In addition, the quenching method is quite troublesome. Also, it is difficult to control the thickness of the amorphous alloy film and to vary the contour of the film in a preselected pattern.

SUMMARY OF THE INVENTION

The present invention provides a method wherein an amorphous alloy can be easily manufactured through the use of a single amorphous alloy forming element. The method of the present invention provides a means for controlling thickness and contour of an amorphous alloy film without difficulty.

In accordance with a preferred form of the invention, the method of manufacturing the amorphous alloy comprises the steps of preparing an acidic plating bath consisting predominantly of divalent iron ions and a source of hypophosphite ions such as hypophosphorous acid or an alkali metal hypophosphite, and effecting an electroplating by the use of such plating bath to produce a plated layer of an amorphous alloy consisting predominantly of iron and phosphorous.

BRIEF DESCRIPTION OF THE DRAWINGS

FIG. 4 is a diagram showing the relationship between pH value of the plating bath and oxidation-reduction potentials of phosphorous containing ions;

FIG. 5 is a cross-sectional view of an aluminum test piece on which a plated film of an iron-phosphorous amorphous alloy has been formed according to the present invention;

DESCRIPTION OF THE PREFERRED EMBODIMENTS

Figure 1:
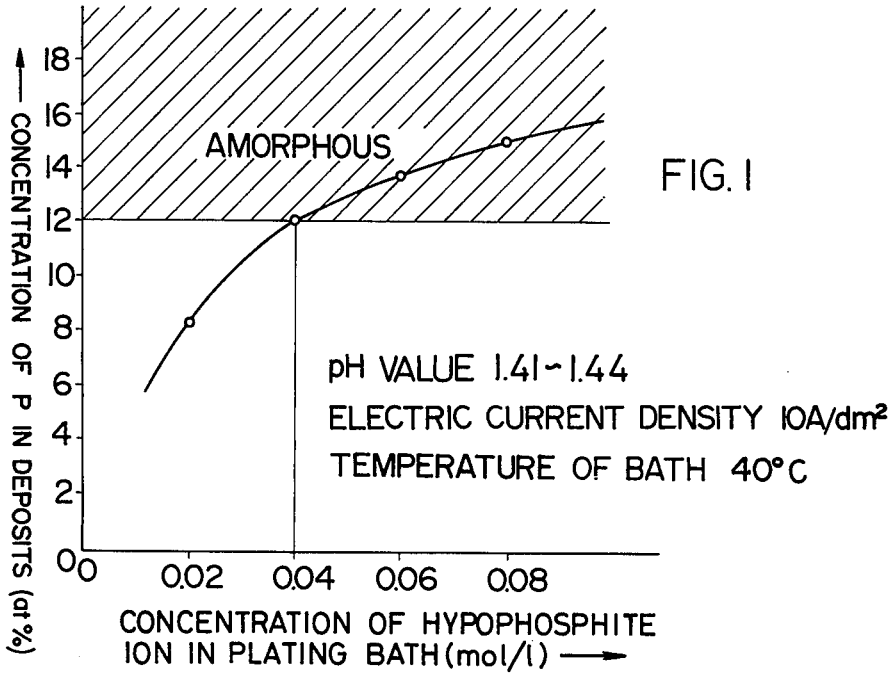
FIG. 1 is a graph showing the relationship between the concentration of hypophosphite in the plating bath and the concentration of phosphorous in the plated deposit, and illustrating the amorphous region.

This invention relates to a method of manufacturing an amorphous alloy comprising the steps of preparing an acidic plating bath consisting predominantly of divalent iron ions and a source of hypophosphite ions, and effecting an electroplating by the use of the bath to produce a plated layer of an amorphous alloy consisting predominantly of iron and phosphorous, usually from 60 to 88 atomic percent iron, and 12 to 30 atomic percent phosphorous.

It has been found that the iron content should be 60 to 88 atomic percent because the plated alloy is hard to deposit and its magnetic flux density is decreased due to the increased concentration of phosphorous when the iron content is below 60 atomic percent. It is furthermore difficult to obtain an amorphous alloy when the iron content is above 88 atomic percent and the concentration of phosphorous is correspondingly decreased. The phosphorous content should be from 12 to 30 atomic percent because the electrical resistance becomes too high, the plated alloy is hard to deposit, and the magnetic flux density is lower when the phosphorous content is above 30 atomic percent.

Figure 2:
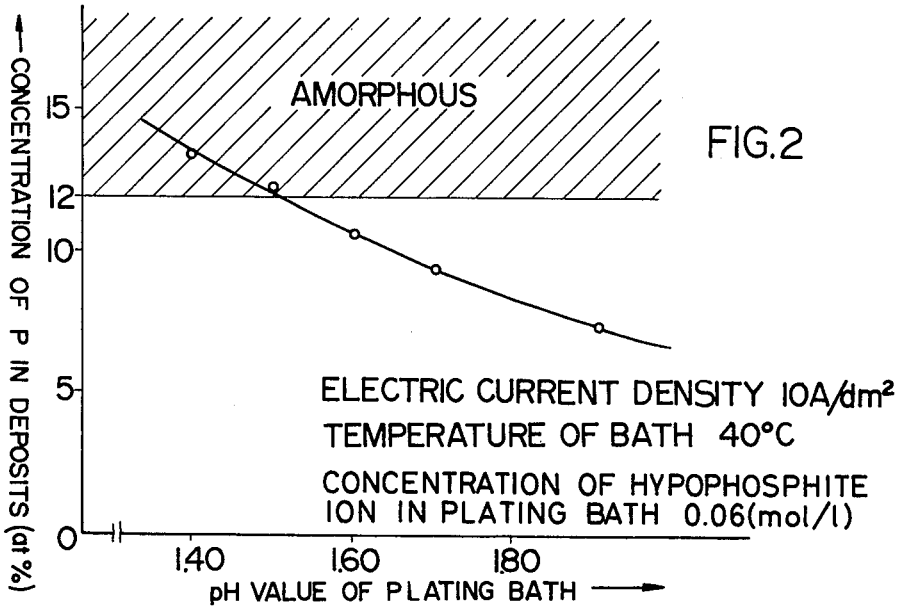
FIG. 2 is a graph showing the relationship between the pH of the plating bath and the concentration of phosphorous in the plated deposit, also illustrating the amorphous region.

FIG. 1 shows a relationship between the concentration of hypophosphite ions in the plating bath and the concentration of phosphorous in the plated film when the plating was effected under conditions subsequently described. FIG. 2 shows the concentration of phosphorous in a plated film as a variation of the pH of the plating bath using the subsequently described sulfamic acid bath.

The amorphous alloy according to the present invention may be an amorphous alloy of Fe—P, Fe—Ni—P, Fe—Co—P or Fe—Ni—Co—P, wherein the alloy contains from 0 to 10 atomic percent nickel or cobalt or mixtures of the two. From 1 to 2 atomic percent of chromium or the like can be added to improve the anti-corrosion properties. In this connection, however, divalent iron is undesirably oxidized to trivalent iron unless the chromium exists in the plating bath as trivalent chromium.

In the method of manufacturing the amorphous alloy, divalent iron ions can be obtained from sources such as ferrous sulfate, ferrous sulfamate, or mixtures of these materials. The hypophosphite ion source can be hypophosphorous acid ($H_3PO_2$) or an alkali metal hypophosphite such as sodium hypophospite ($NaH_2PO_2$) or potassium hypophosphite ($KH_2PO_2$) or the like.

The plating process is believed to progress as follows. The ferrous salt, for example, ferrous sulfate in the plating bath is dissociated into divalent ferrous ions and sulfate ions and the resulting divalent ferrous ions migrate to the cathode where they are reduced and electrodeposited as metallic iron. The hypophosphite source such as sodium hypophosphite is dissociated into sodium ions and hypophosphite ions and these ions are changed to sodium hydroxide and hypophosphorous acid by the action of water. The resulting sodium hydroxide is changed to sodium sulfate because of the low pH value of the plating bath. The hypophosphite is changed almost completely to hypophosphorous acid which supplies the plated alloy with phosphorous atoms. The sodium of the sodium hypophosphite helps to stabilize the hypophosphite.

It is preferable that the plating bath according to this invention has the following basic composition, and that the electroplating proceeds under the following conditions:

| | |
|---|---|
| $FeSO_4 . 7H_2O$ | about 100 to 500 g/l (1/3 to 5/3 mol/l) |
| $NaH_2PO_2 . H_2O$ | about 8 to 45 g/l (0.07 to 0.42 mol/l) |
| pH value | 1.0 to 2.2 |
| Electric current density | 3 to 20A/dm$^2$ |
| Temperature of plating bath | 30 to 50° C |

The sodium hypophosphite concentration is most preferably in the range from 8 to 30 g/l (0.07 to 0.26 mol/l). Regardless of the source of ferrous ions or hypophosphite ions, their concentrations should be from 1/3 to 5/3 mol/l for the ferrous ions and 0.07 to 0.42 mol/l for the hypophosphite ions.

In addition to the constituents mentioned above, a stabilizer such as L-ascorbic acid, a source of nickel such as nickel sulfate ($NiSO_4 . 7H_2O$) or a cobalt source such as cobalt sulfate ($CoSO_4 . 7H_2O$) can be added to the plating bath. The use of the above-mentioned stabilizer is preferred because it prevents the divalent iron ions from being oxidized to trivalent iron ions. A practical concentration of the stabilizer ranges from 2 to 10 g/l in the plating bath. Boric acid or ammonium chloride can be added to the plating bath if required.

The pH value should be maintained in the range of 1.0 to 2.2 because the plated alloy is difficult to deposit when the pH value is below 1.0 and the concentration of phosphorous is increased, and because it is difficult to obtain an amorphous plated alloy when the plated metal is deposited at a pH value above 2.2. The electric current density should also be maintained in the indicated range of 3 to 20A/dm$^2$ because it is difficult to effect the plating process when the current density is below the minimum stated, and because burnt deposits are produced on the electrode when the current density is in excess of 20A/dm$^2$. The temperature of the plating bath should not be too high because the constituents in the plating bath precipitate easily.

Figure 3:
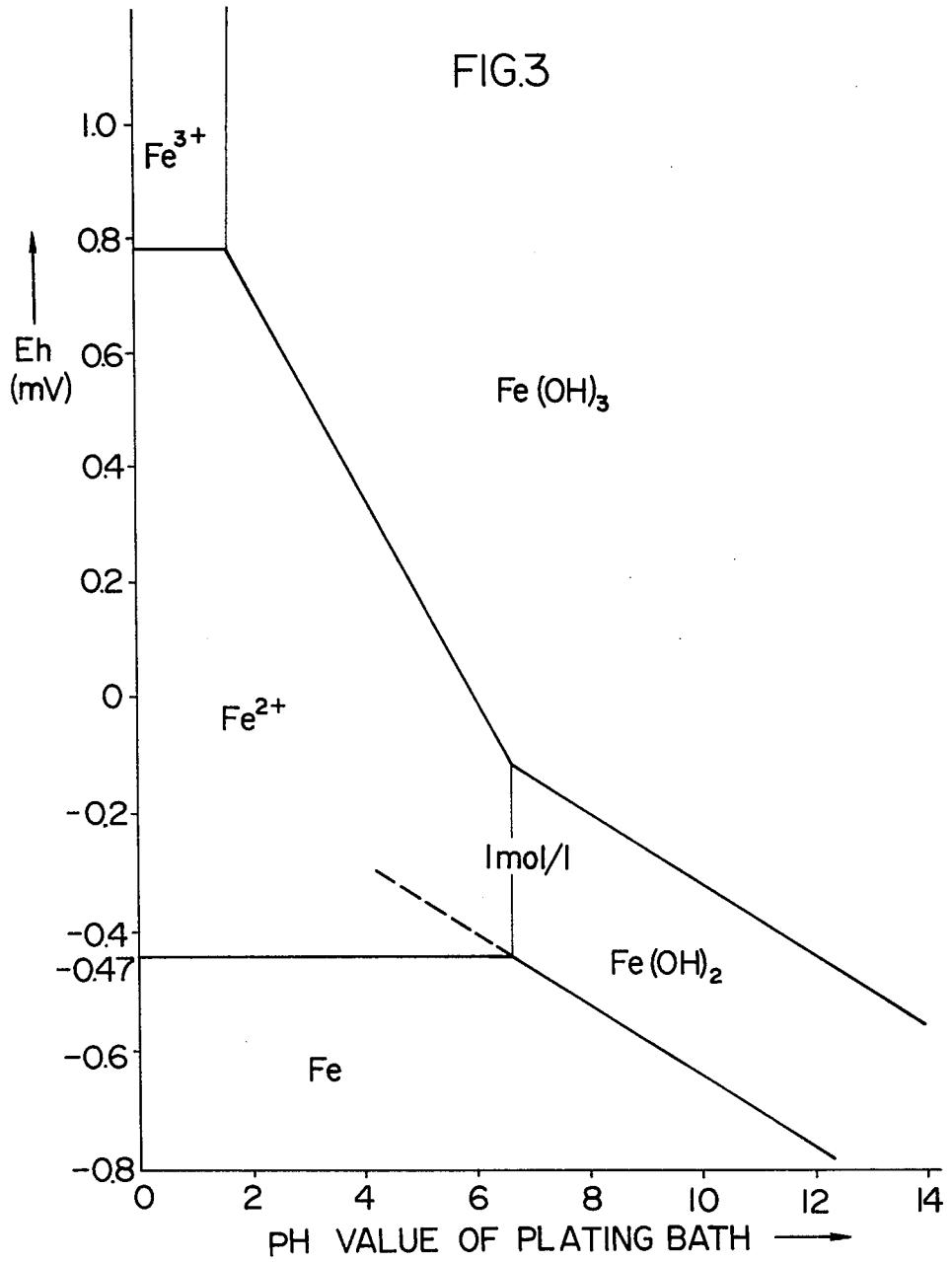
FIG. 3 is a diagram showing the relationship between pH of the plating bath and the oxidation-reduction potential of iron ions.

FIG. 3 shows the relationship between the pH value of the plating bath and the oxidation-reduction potential Eh of iron group ions. According to FIG. 3 it will be understood that the oxidation-reduction potential between Fe and $Fe^{2+}$ is −0.47 mV and is constant at pH values of from 0 to 6. FIG. 4 shows the relationship between pH value of the plating bath and the oxidation-reduction potential Eh of phosphorous-containing ions. The above potential (−0.47mV) of the iron group and the corresponding potential of the phosphorous group ions should approach each other in order to obtain a plated eutectic alloy of iron and phosphorous. However, according to FIG. 4, it will be noted that the oxidation-reduction potential between P and $H_3PO_2$ or $H_2PO_2^-$ tends to substantially decrease so that it is difficult to form the eutectic at the oxidation-reduction potential of iron and it becomes difficult to produce an amorphous alloy when the pH is above 2.0. For this reason, it is necessary to keep the pH value below about 2.2, and preferably at 1.5 to 2.0 in order to produce an amorphous alloy under the conditions wherein the oxidation-reduction potential Eh of phosphorous approaches the oxidation-reduction potential of iron in FIG. 4.

The above-described composition of the plating bath may be varied, for example, by using 1/3 to 5/3 mole of ferrous sulfamate ($Fe(NH_3SO_3)_2$). instead of the ferrous sulfate. To this modified composition 0 to 130 g/l of urea can be added to provide a lower activity and increase brightness, 20 to 60 g/l of ammonium sulfamate can be added to exhibit a buffer action and control the pH value, and a small amount of additional brighteners can be added. An amorphous alloy of Fe—Ni—P or Fe—Co—P can also be produced by the addition of proper amounts of nickel sulfamate or cobalt sulfamate.

The amorphous alloy produced in the above manner is a plated alloy having a satin finished surface in most cases, having a relatively rough surface of a surface roughness of 20 to 50 microns. Accordingly, it is desirable to add cupric ions functioning as a brightener in the plating bath, the copper being taken up into the amorphous alloy. By the addition of copper, an amorphous alloy consisting mainly of iron and phosphorous exhibits a bright surface and a bright plated alloy with a mirror-like appearance can be produced.

The divalent copper ion to be added can be supplied by copper sulfate ($CuSO_4 . 5H_2O$), copper sulfamate ($Cu(NH_2SO_3)_2$), cupric chloride ($CuCl_2$) or mixtures of these materials. The sources of cupric ions are soluble in the plating bath.

A plating bath containing cupric ions according to the present invention can include the following basic composition, and plating can be effected under the following conditions:

| | |
|---|---|
| $FeSO_4 . 7H_2O$ | 100 to 500 g/l |
| $NaH_2PO_2 . H_2O$ | 8 to 45 g/l |
| $CuSO_4 . 5H_2O$ | 0.01 to 2 g/l |
| pH value | 1.0 to 2.2 |
| Electric current density | 3 to 20 A/dm$^2$ |
| Temperature of plating | |

-continued

| | |
|---|---|
| bath | 30 to 50° C |

As in the case where the plating bath contains no cupric ions, a stabilizer such as ascorbic acid in a concentration of 2 to 10 g/l can be added to the plating bath. Suitable amounts of nickel sulfate, cobalt sulfate, boric acid or ammonium chloride can be added to the above basic composition and to this plating bath as well.

The concentration of cupric sulfate is limited to 0.01 to 2 g/l ($4 \times 10^{-5}$ to $8 \times 10^{-3}$ mole/l) because it is difficult to provide suitable brightness to the plated alloy when the amount is below 0.01 g/l and the copper is deposited on the plated alloy surface when the amount is more than 2 g/l.

The present invention has an advantage that an amorphous alloy consisting only of iron and phosphorous can be manufactured through the use of the acidic plating bath from ferrous sulfate and sodium hypophosphite. The plating operation is considerably simplified when compared with the conventional method of making amorphous alloys and the amount of phosphorous is relatively decreased because of the plating method involved. The thickness and the contour of the plated alloy film can also be much more easily controlled. In addition, the amorphous alloy produced by the method of this invention has highly acceptable properties, such as high mechanical strength, an almost complete absence of work hardening, a relatively low modulus of rigidity, a high electrical resistance and a high permeability. Accordingly, the amorphous alloy according to the present invention can be used for small parts, laminated materials, plates, wire rods requiring a given strength, as well as for magnetic materials.

In the manufacture of an amorphous alloy by the use of the above plating bath, a pretreatment can be performed before the main plating occurs. For example, the material to be plated consisting, for example, of a copper test piece can be degreased and washed first by treatment with vapors of trichloroethylene and the cathode can be washed by means of a suitable cleaner such as 30 g/l "Metalex W Special" before being washed with water. In another pretreatment, an aluminum test piece can be washed by trichloroethylene vapors, and a thin copper strike can be provided on the test piece by the use of a copper cyanide bath in accordance with the zinc or tin substitution method. An additional amount of copper can be further plated on the thin striked copper film by means of copper pyrophosphate.

The following specific examples illustrate variations in the plating process which can be used according to the present invention.

EXAMPLE 1

An aqueous acidic plating bath was made up with the following composition:

| | |
|---|---|
| $FeSO_4 \cdot 7H_2O$ | 300 g/l |
| $H_3BO_3$ | 30 g/l |
| L-asorbic acid | 5 g/l |
| $NaH_2PO_2$ | 21 g/l |
| $NH_4Cl$ | 20 g/l |

The plating process was performed in the bath under the following conditions:

| | |
|---|---|
| pH value | 2.2 |
| Electric current density | 10 A/dm$^2$ |
| Temperature of plating bath | 40° C |

The resulting structure is shown in FIG. 5. There was produced an amorphous alloy plated film 3 of iron-phosphorous with a thickness of 30 to 100 microns, usually about 50 microns deposited on a copper film 2 with a thickness of about 1 micron formed on an aluminum test piece 1 with a thickness of about 0.2 mm. In order to remove the plated film 3, the aluminum test piece 1 can be first etched off by sodium hydroxide or potassium hydroxide, and the copper film 2 can then be electrolytically etched off by a mixture of ammonium hydroxide and ammonium chloride.

The thickness of the plated film 3 can be widely varied by the control of the concentration of the constituents and the pH value of the plating bath, the electric current density and the like. Also, a plating resist layer (not shown) having a predetermined pattern can be formed on the surface of the copper film 2, so that the plated film 3 deposits on the portions other than the resist layer so plated films having various patterns can be easily formed corresponding to the contour of the resist layer.

Figure 6:
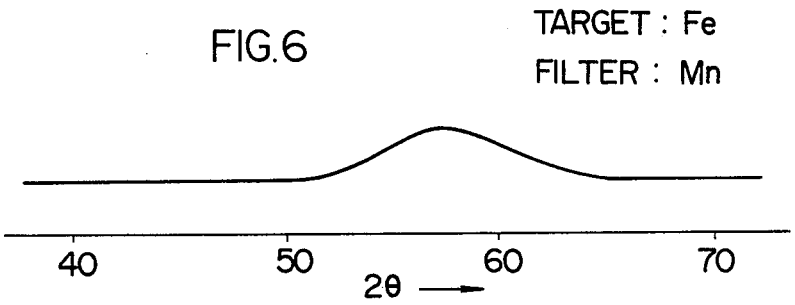
FIG. 6 is an X-ray diffraction spectrum of an iron-phosphorous system amorphous alloy according to this invention.

An X-ray diffraction analysis on the manufactured amorphous alloy was performed. A broad spectrum was obtained and a spectrum peak which would be peculiar to a crystalline substance did not appear, as shown in FIG. 6.

Figure 7:
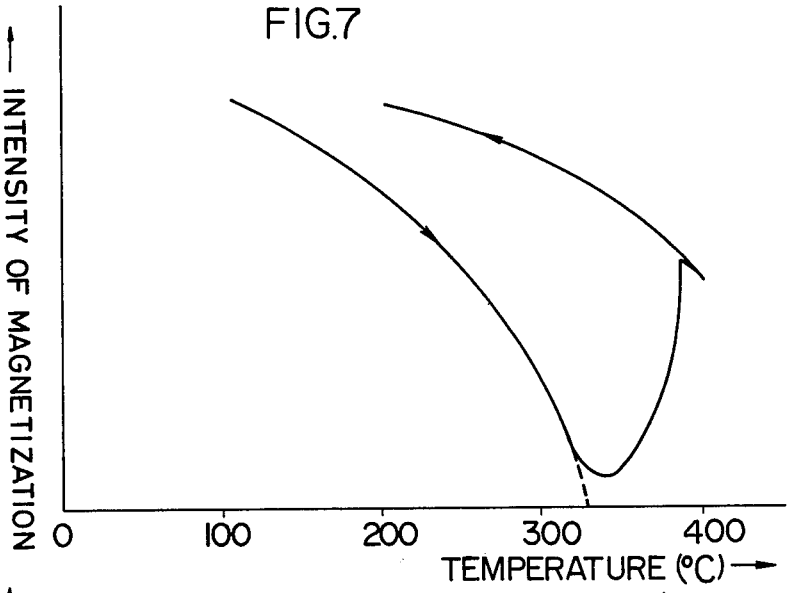
FIG. 7 is a graph showing the magnetization characteristics of the alloy upon changes in temperature.

The relationship between the magnetization and temperature, as measured by a magnetic balance, is shown in FIG. 7. It will be seen that the magnetization of the amorphous alloy is decreased as the temperature increases and then increases as the temperature further increases above about 300° C, whereas the magnetization of a crystalline substance is decreased to 0 (at the Curie point) as shown by the dotted line at temperatures above 300° C.

Figure 8:
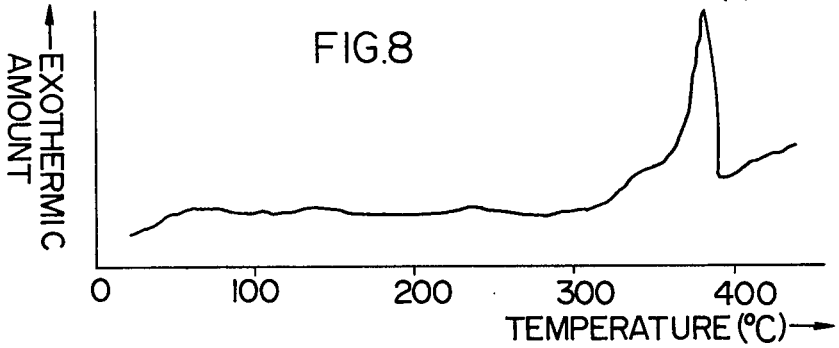
FIG. 8 is a graph showing the result of a differential thermal analysis of the amorphous alloy shown in FIG. 6.

FIG. 8 shows the result of a differential thermal analysis on the plated film. From this graph, it will be apparent that an exothermic reaction by differential heating resulting from the crystallization of the amorphous material is developed at a temperature which causes the increase in the magnetization shown in FIG. 7.

The amorphous alloy of iron and phosphorous obtained in this example analyzed $Fe_{85.1}P_{14.9}$ and had a magnetic flux density Bm of 13,200 gauss.

EXAMPLE 2

An acidic plating bath having the following composition was prepared.

| | |
|---|---|
| $FeSO_4 \cdot 7H_2O$ | 300 g/l |
| $H_3BO_3$ | 30 g/l |
| L-asorbic acid | 5 g/l |
| $NaH_2PO_2 \cdot H_2O$ | 8.5 g/l |
| $NH_4Cl$ | 20 g/l |

The plating was performed under the following conditions:

| | |
|---|---|
| pH value | 1.8 |
| Electric current density | 10 A/dm$^2$ |
| Temperature of | |

-continued

| | |
|---|---|
| plating bath | 40° C |

In the above plating bath, the amount of sodium hypophosphite was less than used in Example 1 but an amorphous alloy similar to that obtained in Example 1 was made.

EXAMPLE 3

An acidic plating bath having the following composition was prepared, and the plating process was carried out under the same conditions as specified in Example 2.

| | |
|---|---|
| $FeSO_4 \cdot 7H_2O$ | 278 g/l |
| $NiSO_4 \cdot 7H_2O$ | 8 g/l |
| $H_3BO_3$ | 30 g/l |
| L-ascorbic acid | 5 g/l |
| $NaH_2PO_2 \cdot H_2O$ | 10.6 g/l |
| $NH_4Cl$ | 30 g/l |

The amorphous alloy which resulted analyzed $Fe_{85.}Ni_{2.1}P_{12.9}$. The X-ray diffraction analysis of the amorphous alloy showed the same broad spectrum as in FIG. 6, and the other properties of the alloy were similar to those obtained in Example 1.

EXAMPLE 4

An acidic plating bath having the following composition was used, in conjunction with a plating process performed under the same conditions as in Example 2:

| | |
|---|---|
| $FeSO_4 \cdot 7H_2O$ | 278 g/l |
| $CoSO_4 \cdot 7H_2O$ | 5 g/l |
| $H_3BO_2$ | 30 g/l |
| L-ascorbic acid | 5 g/l |
| $NaH_2PO_2 \cdot H_2O$ | 10.6 g/l |
| $NH_4Cl$ | 30 g/l |

The amorphous alloy manufactured from this plating bath had the analysis $Fe_{84.1}Co_{2.8}P_{13.1}$.

EXAMPLE 5

An acidic plating bath having the following composition was made up:

| | |
|---|---|
| Ferrous sulfamate (calculated as Fe) | 56 g/l |
| L-ascorbic acid | 5 g/l |
| Urea | 120 g/l |
| Ammonium sulfamate | 40 g/l |
| $NaH_2PO_2 \cdot H_2O$ | 10.6 g/l |
| Brightener | small amount |

A plating process was performed with the foregoing bath under the following conditions:

| | |
|---|---|
| pH value | 1.83 |
| Electric current density | 10 A/dm$^2$ |
| Temperature of plating bath | 30° C |

Figure 9:
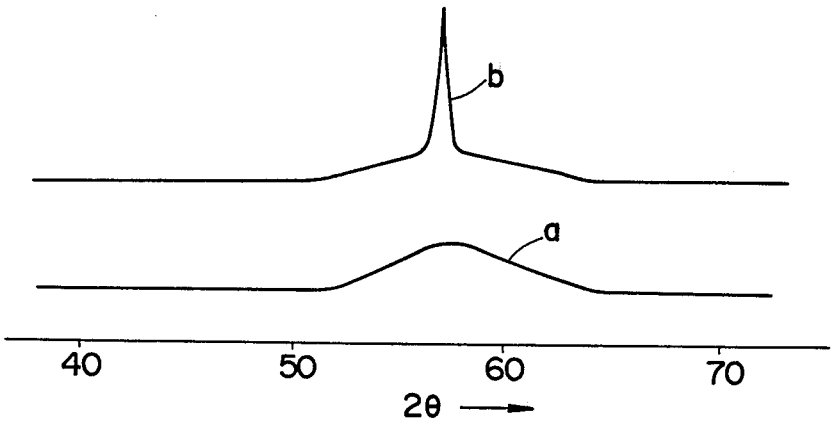
FIG. 9 is an X-ray diffraction spectrum of alpha iron and another iron-phosphorous system amorphous alloy according to this invention.

An X-ray diffraction analysis of the amorphous alloy deposited from the above plating bath was obtained as shown by spectrum a in FIG. 9 which compares the diffraction pattern of the amorphous alloy with a spectrum b of alpha iron which exhibits a sharp peak.

Figure 10:
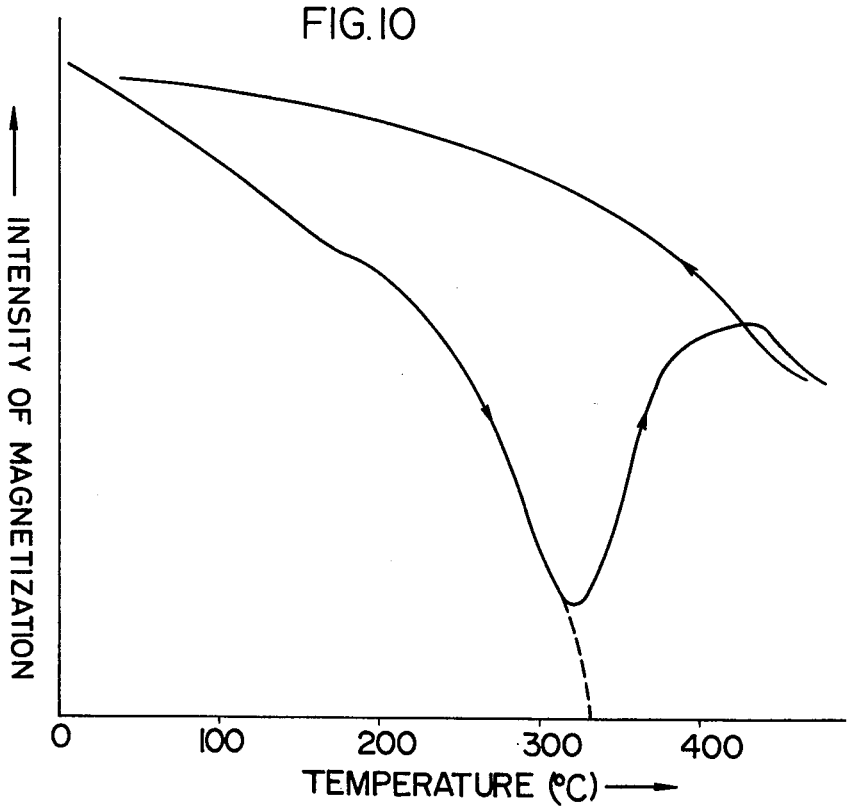
FIG. 10 is a graph showing the variation in magnetization properties of the amorphous alloy used in FIG. 9.
Figure 11:
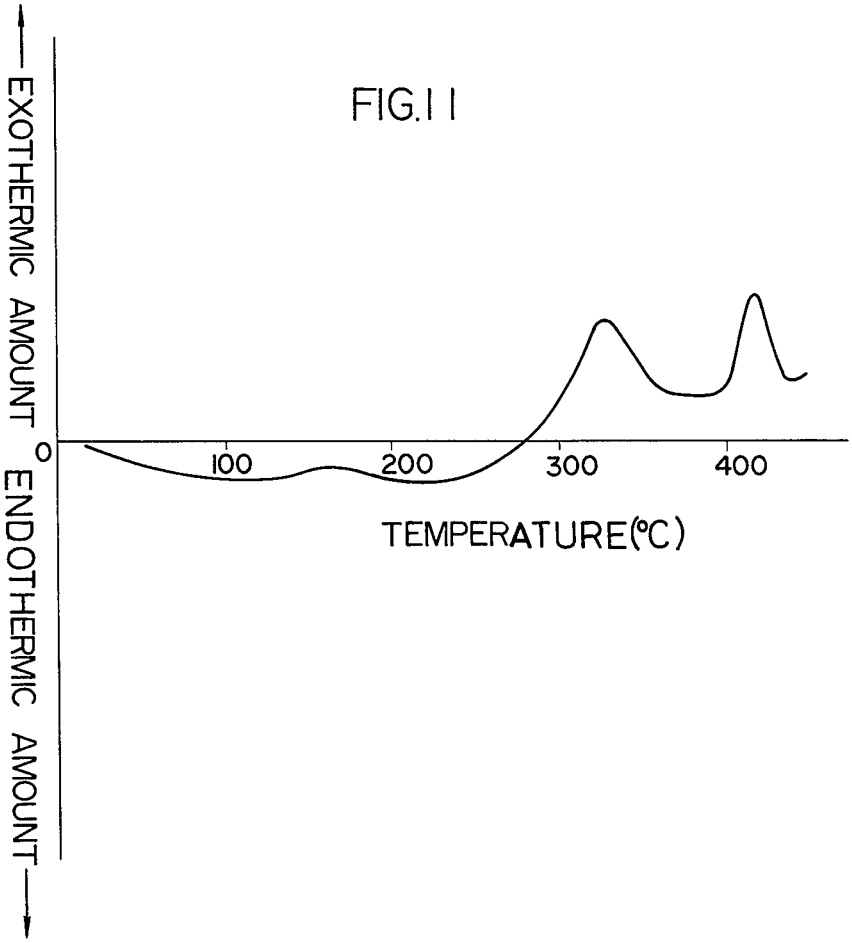
FIG. 11 is a graph showing the result of a differential thermal analysis on the amorphous alloy used in FIG. 9.

The alloy obtained in this example analyzed $Fe_{87.2}P_{12.8}$. It had a magnetic flux density Bm of 14,200 gauss as measured by a magnetic balance. The relationship of temperature to magnetization of this alloy is shown in FIG. 10. The magnetization decreases as the temperature rises and then reverses to increase at more elevated temperatures, which is contrary to the behavior of a crystalline material as indicated by the dotted line. The differential thermal analysis shown in FIG. 11 indicates that the reaction changes from an endothermic reaction to an exothermic reaction as the temperature rises, caused by crystallization of the amorphous material.

For purposes of comparison the pH value of the plating bath was changed to 2.27 and the plating process was performed. As a result, a peak shown by spectrum *b* in FIG. 9 corresponding to that at (110) of alpha iron was obtained and the plated alloy was shown not to be amorphous.

EXAMPLE 6

In the plating bath of Example 5, the amount of sodium hypophosphite was changed to 42 g/l and 20 g/l of boric acid were added. Through the use of this bath, a plating process was performed under the following conditions:

| | |
|---|---|
| pH value | 1.68 |
| Electric current density | 7A/dm$^2$ |
| Temperature of plating bath | 40° C |

An X-ray diffraction of the alloy deposited from the above bath was similar to that shown by the spectrum *a* in FIG. 9, indicating that the alloy was amorphous. The composition was analyzed as $Fe_{71.8}P_{28.2}$ and found to have a magnetic flux density Bm of 12,000 gauss.

EXAMPLE 7

A plating process was performed as stated in Example 5, with the addition of 2.0 g/l of nickel sulfamate to the plating bath. The resulting plated alloy film had the composition $Fe_{87.2}Ni_{0.4}P_{12.4}$. The The plated alloy had a magnetic flux density Bm of 13,700 gauss, and showed a temperature-magnetization property and a differential thermal analysis which were not significantly different from those shown in FIGS. 10 and 11.

EXAMPLE 8

A plating process was performed as in Example 5 except that 10 g/l of nickel sulfamate were added to the plating bath. The resulting plated alloy film had a composition of $Fe_{85.2}Ni_{1.9}P_{12.9}$ and had a magnetic flux density Bm of 13,300 gauss.

EXAMPLE 9

A plating process was performed under the conditions of Example 5, with the addition of 5 g/l of cobalt sulfamate. The resulting plated alloy film had a composition of $Fe_{85.2}Co_{1.8}P_{13.0}$ and had a magnetic flux density, Bm of 13,500 gauss. The temperature-magnetization properties and the differential thermal analysis were almost unchanged from those shown in FIGS. 10 and 11.

EXAMPLE 10

An acidic plating bath having the following composition was prepared:

| |
|---|
| Ferrous sulfamate |

-continued

| | |
|---|---|
| (calculated as Fe) | 56 g/l |
| L-ascorbic acid | 5 g/l |
| $H_3BO_3$ | 20 g/l |
| Ammonium sulfamate | 60 g/l |
| $NaH_2PO_2 . H_2O$ | 21.2 g/l |
| Saccharin sodium | 2 g/l |
| $CuSO_4 . 5H_2O$ | 0.2 g/l |

Through the use of the plating bath, a plating process was performed under the following conditions:

| | |
|---|---|
| pH value | 1.72 |
| Electric current density | 7A/dm$^2$ |
| Temperature of plating bath | 40° C |

A bright amorphous alloy was obtained from the above plating bath. An X-ray diffraction on the alloy showed a broad spectrum which differed from the spectrum of alpha iron which exhibits a sharp peak. This fact indicated that the alloy obtained was amorphous. The alloy had a composition of $Fe_{79.2}P_{20.5}Cu_{0.3}$ according to an analysis, and a magnetic flux density Bm of 14,100 gauss. It had an initial permeability of 1,700 when exposed to a magnetic field of 1 KHz.

Figure 12:
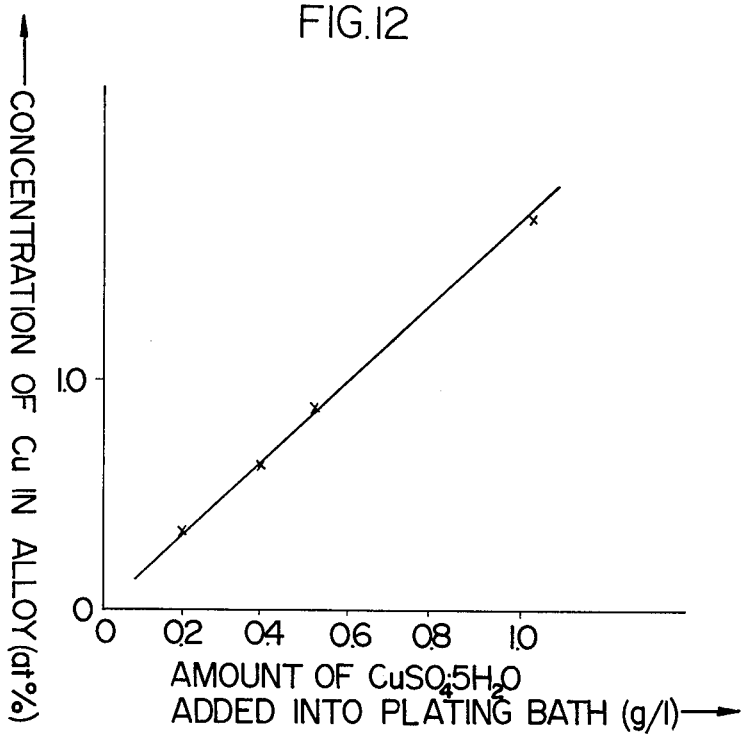
FIG. 12 is a graph showing the relationship between the amount of copper sulfate added into a plating bath and the concentration of copper in the amorphous alloy according to the present invention.

In this example, the cupric ion brightener was added as $CuSO_4 . 5H_2O$ to the plating bath so that the copper was taken or contained in the amorphous alloy as a result of the electroplating. It was shown that the amount of copper taken in the alloy was almost linearly the amount of added cupric sulfate as shown in FIG. 12. In the case of the amount of cupric sulfate was very small, it was found that the magnetic flux density was not significantly changed.

The thickness of the plated alloy film can be freely varied by controlling concentration of constituents and the pH value of the plating bath, electric current density and the like. When a plating resist layer with a predetermined pattern is formed on a copper film which has been formed on the surface of a material to be plated with the above-mentioned pretreatment, the plated alloy deposits on the portions other than the resist layer, so that a plated alloy film with various patterns can be obtained.

EXAMPLE 11

An acidic plating bath having the following composition was prepared:

| | |
|---|---|
| $FeSO_4 . 7H_2O$ | 300 g/l |
| L-ascorbic acid | 5 g/l |
| $H_3BO_3$ | 30 g/l |
| $NaH_2PO_2 . H_2O$ | 8.5 g/l |
| $NH_4Cl$ | 20 g/l |
| $CuSO_4 . 5H_2O$ | 1.0 g/l |

Through the use of this plating bath, a plating process was performed under the following conditions:

| | |
|---|---|
| pH value | 1.8 |
| Electric current density | 10A/dm$^2$ |
| Temperature of plating bath | 40° C |

The result was a bright amorphous alloy having a composition $Fe_{78.5}P_{19.9}Cu_{1.6}$. The amorphous alloy had a magnetic flux density of 14,000 gauss.

EXAMPLE 12

A plating process was performed as stated in Example 10, with the addition of 2.0 g/l of nickel sulfamate to the plating bath. A bright amorphous alloy of Fe—Ni—P was obtained.

EXAMPLE 13

A plating process was performed as in Example 10 with the addition of 10 g/l of nickel sulfamate. The amorphous alloy obtained had higher nickel content than that obtained in Example 12.

EXAMPLE 14

A plating process was performed as in Example 10 with the addition of 5 g/l of cobalt sulfamate to the bath. A bright amorphous alloy of Fe—Co—P was obtained.

It will be evident that various modifications can be made to the described embodiments without departing from the scope of the present invention.

I claim as my invention:

1. A method of manufacturing an amorphous plated layer alloy consisting essentially of from 60 to 88 atomic percent iron and from 12 to 30 atomic percent phosphorous and up to 10 atomic percent nickel and/or cobalt comprising providing an acidic aqueous plating bath containing:

1/3 to 5/3 mole/l divalent iron ions 0.07 to 0.42 mole/l hypophosphite ions and effecting the electroplating through the use of said bath under the following conditions:

| | |
|---|---|
| pH | 1.0 to 2.2 |
| Current density | 3 to 20A/dm$^2$ |
| Temperature | 30 to 50° C |

2. A method according to claim 1 wherein the divalent ferrous ions are derived from ferrous sulfate, ferrous sulfamate, or a mixture thereof.

3. A method of manufacturing an amorphous alloy according to claim 1 wherein said source of hypophosphite ions is an alkali metal hypophosphite or hypophosphorous acid.

4. A method according to claim 1 wherein said plating bath further contains divalent cupric ions to produce an amorphous alloy containing iron, phosphorous and copper.

5. A method according to claim 4 wherein the cupric ions are derived from copper sulfate, copper sulfamate, cupric chloride, or mixtures of these materials.

6. A method according to claim 5 wherein the amount of divalent copper is from $4 \times 10^{-5}$ to $8 \times 10^{-3}$ mole/l.

7. A method according to claim 1 in which the hypophosphite ion is present in an amount of 0.07 to 0.26 mole/l.

8. A method of manufacturing an amorphous plated layer alloy consisting predominantly of iron and phosphorous comprising providing an acidic aqueous plating bath containing:

1/3 to 5/3 mole/l divalent iron ions 0.07 to 0.42 mole/l hypophosphite ions $4 \times 10^{-5}$ to $8 \times 10^{-3}$ mole/l cupric ions and effecting the electroplating through the use of said plating bath under the following conditions:

| | |
|---|---|
| pH | 1.0 to 2.2 |
| Current density | 3 to 20A/dm$^2$ |
| Temperature | 30 to 50° C |

9. A method according to claim 8 wherein the divalent iron ions are derived from ferrous sulfate, ferrous sulfamate, or a mixture thereof.

10. A method of manufacturing an amorphous alloy according to claim 8 wherein the source of hypophosphite ions is an alkali metal hypophosphite or hypophosphorous acid.

11. A method according to claim 8 in which the hypophosphite ion is present in an amount of 0.07 to 0.26 mol/liter.

12. A method according to claim 8 in which said amorphous alloy contains 60 to 88 atomic percent iron and 12 to 30 atomic percent phosphorous.

13. A method according to claim 2 wherein said amorphous alloy contains up to 10 atomic percent nickel and/or cobalt.

* * * * *